US008317497B2

(12) United States Patent
Finkenbinder

(10) Patent No.: US 8,317,497 B2
(45) Date of Patent: Nov. 27, 2012

(54) MOTOR-FAN ASSEMBLY HAVING A TAPERED STATIONARY FAN WITH A CONCAVE UNDERSIDE

(75) Inventor: David B. Finkenbinder, Ravenna, OH (US)

(73) Assignee: Ametek, Inc., Paoli, PA (US)

( * ) Notice: Subject to any disclaimer, the term of this patent is extended or adjusted under 35 U.S.C. 154(b) by 420 days.

(21) Appl. No.: 12/716,720

(22) Filed: Mar. 3, 2010

(65) Prior Publication Data

US 2011/0217195 A1 Sep. 8, 2011

(51) Int. Cl.
*F04B 35/04* (2006.01)
*F04D 29/44* (2006.01)
*B63H 1/16* (2006.01)

(52) U.S. Cl. ..... 417/423.14; 415/199.3; 415/208.2; 415/211.2; 416/188

(58) Field of Classification Search ..... 417/423.14; 415/199.1–199.3, 208.2, 211.2; 416/186 R, 416/188
See application file for complete search history.

(56) References Cited

U.S. PATENT DOCUMENTS 2,970,750 A * 2/1961 Swearingen ..... 415/1
4,621,991 A 11/1986 Smith et al. ..... 417/423 A
5,296,769 A 3/1994 Havens et al. ..... 310/90
6,166,462 A 12/2000 Finkenbinder et al. ..... 310/63
6,439,843 B1 8/2002 Finkenbinder ..... 415/172.1
6,695,580 B2 2/2004 Finkenbinder ..... 415/208.3
6,703,754 B1 3/2004 Finkenbinder et al. ..... 310/227
7,091,635 B1 8/2006 Gilliland et al. ..... 310/62
7,132,777 B2 11/2006 Finkenbinder et al. ..... 310/239
7,766,613 B2 * 8/2010 Fukuki ..... 415/199.2
2007/0224040 A1 * 9/2007 Kawabata et al. ..... 415/199.2
2008/0206050 A1 * 8/2008 Finkenbinder et al. .... 415/208.2
2009/0191061 A1 * 7/2009 Lacey et al. ..... 416/214 R

* cited by examiner

*Primary Examiner* — Charles Freay
(74) *Attorney, Agent, or Firm* — Renner Kenner Greive Bobak Taylor & Weber

(57) ABSTRACT

A motor-fan unit includes an end plate assembly, a motor assembly supported by the end plate assembly, and a shaft rotated by the motor assembly and extending through the end plate assembly. The fan assembly further includes a discharge shell, a tapered stationary fan which has a concave underside, and a rotating fan secured to the rotatable shaft and disposed between the discharge shell and the stationary fan. The tapered stationary fan includes a fan side which is substantially parallel and aligned with the frusto-conical shape of the fan disc of the rotating fan. A tapered fan shell is supported by the discharge shell and held in place by the stationary fan. A fan shroud secures the stationary fan and the fan shell to the discharge shell to prevent damage to a rotating fan secured to the shaft and positioned between the fan shroud and the stationary fan.

16 Claims, 7 Drawing Sheets

MOTOR-FAN ASSEMBLY HAVING A TAPERED STATIONARY FAN WITH A CONCAVE UNDERSIDE

TECHNICAL FIELD

The present invention generally relates to a tapered stationary fan used in association with a motor-fan assembly. More particularly, the present invention relates to a motor-fan assembly having a tapered stationary fan with a concave underside. The present invention also relates to a multi-stage fan assembly wherein a fan shroud is stepped and mated with the tapered stationary fan to preclude damage to internal rotating fans.

BACKGROUND OF THE INVENTION

Electric motors are well known in the art and have been put to use in a variety of applications, including the handling of air. In this circumstance, an electric motor is coupled to a fan, creating a motor-fan unit, which produces an airflow as needed. When providing air movement, the motor-fan unit may supply cooling air to the motor, so as to maintain the motor's operating temperature at an optimal level, allowing the motor's operating life to be extended. The motor-fan unit may also be used to generate working air for vacuum type devices.

To achieve this effect, the fan is mounted on a motor driven shaft, which draws air into a fan shroud. The fan shroud compresses or pressurizes the incoming air, which is resultantly released into the motor housing via one or more ports in a diffuser plate, causing the air to be directed toward the motor windings. As a result, the heat from the motor is drawn into the airflow and exhausted from the motor housing, thus enhancing the motor's operating life. In other embodiments, air passing through the diffuser plate may be collected and routed through a single radial and tangentially extending exhaust port. Such a motor-fan assembly is sometimes referred to as a bypass fan.

In order to efficiently operate the motor-fan assembly, it is important to have efficient air flow through the assembly. In this regard, it has been determined that prior art fan constructions may utilize a rotating fan with a flat ring and a flat fan disc which are parallel to one another and connected to one another by a plurality of curvilinear vanes. This has been improved upon by providing a tapered or convex fan ring and a flat fan disc which allows for more collection of air within the fan before it is exhausted out through the diffuser and a motor assembly. Prior art constructions may also use a diffuser which has a flat fan side and a flat underside. However, it is believed that such a configuration is not as efficient as it could be. Using a fan with a flat fan disc and a diffuser with flat sides requires the air drawn in to make several sharp right angle turns. As such, air does not efficiently move through the fan assembly, causing the motor assembly to work harder and consume more power. Moreover, at some rotational speeds, the sharp turning of the air and resulting turbulent air currents cause air to back up and significantly slow entry of air into the fan. As a result, the fan vanes generate additional noise further hindering performance of the motor-fan assembly. Moreover, it has been determined that the flat configuration of the fan disc causes the shaft to be exposed to unneeded rotational stress forces. These unneeded forces are also believed to adversely affect the bearing from which the motor shaft extends. As a result, the bearing and the motor-fan unit fail prematurely.

Another detriment to fan assemblies which utilize a rotating fan with a flat fan ring is that the length of the motor shaft is extended. At critical speeds, an extended length motor shaft begins to flex resulting in significant operational deficiencies. Prior art multi-stage motor-fan assemblies that utilize an intermediate fan shell are also problematic in that the fan shroud is supported by the intermediate fan shell. Such constructions require a close tolerance fit between the shroud and the fan shell. As a result, minimal forces applied to the shroud cause it to collapse and damage the rotating fan. This damage often occurs during shipping of the motor-fan assemblies.

Therefore, there is a need for a motor-fan unit that utilizes a tapered stationary fan with a concave underside to improve air flow efficiency. Such a configuration allows for efficient movement of air through a fan assembly without generation of deleterious airflow patterns. And there is a need for a motor-fan unit which decreases the axial length of the motor to reduce shaft flexing and improve performance of the motor. There is also a need to configure the tapered stationary fan and associated shroud so as to better protect the rotating fan.

SUMMARY OF THE INVENTION

In light of the foregoing, it is a first aspect of the present invention to provide a motor-fan assembly having a tapered stationary fan with a concave underside.

It is another aspect of the present invention to provide a motor-fan unit comprising an end plate assembly, a motor assembly supported by the end plate assembly, a shaft rotated by the motor assembly and extending through the end plate assembly, and a fan assembly supported by the end plate assembly, the fan assembly comprising a discharge shell attached to the end plate assembly, a rotating fan secured to the rotatable shaft, the rotating fan having a fan disc with a substantially frusto-conical shape, a fan ring and a plurality of vanes connecting the fan disc to the fan ring, and a tapered stationary fan having a tapered fan side opposite a shell side and supported by the discharge shell, the tapered fan side positioned adjacent the fan disc.

Yet another aspect of the present invention is to provide a motor-fan unit comprising an end plate assembly, a motor assembly supported by the end plate assembly, a shaft rotated by the motor assembly and extending through the end plate assembly, and a fan assembly supported by the end plate assembly, the fan assembly comprising a discharge shell attached to the end plate assembly, the discharge shell having a circular wall with a rim, a tapered fan secured to the rotatable shaft, a tapered fan shell that includes an outer edge having a U-shaped ridge and a ledge extending from the U-shaped ridge, the U-shaped ridge forming a groove, a stationary fan having a fan side and a shell side, the stationary fan having an outer periphery with a downwardly extending nub and a radially extending lip, and a rotating fan secured to the rotatable shaft, wherein the tapered fan shell is interposed between the rim and stationary fan such that the U-shaped ridge is received within the circular wall and the nub fits in the groove.

BRIEF DESCRIPTION OF THE DRAWINGS

These and other features and advantages of the present invention will become better understood with regard to the following description, appended claims, and accompanying drawings where:

BEST MODE FOR CARRYING OUT THE INVENTION

Figure 1:
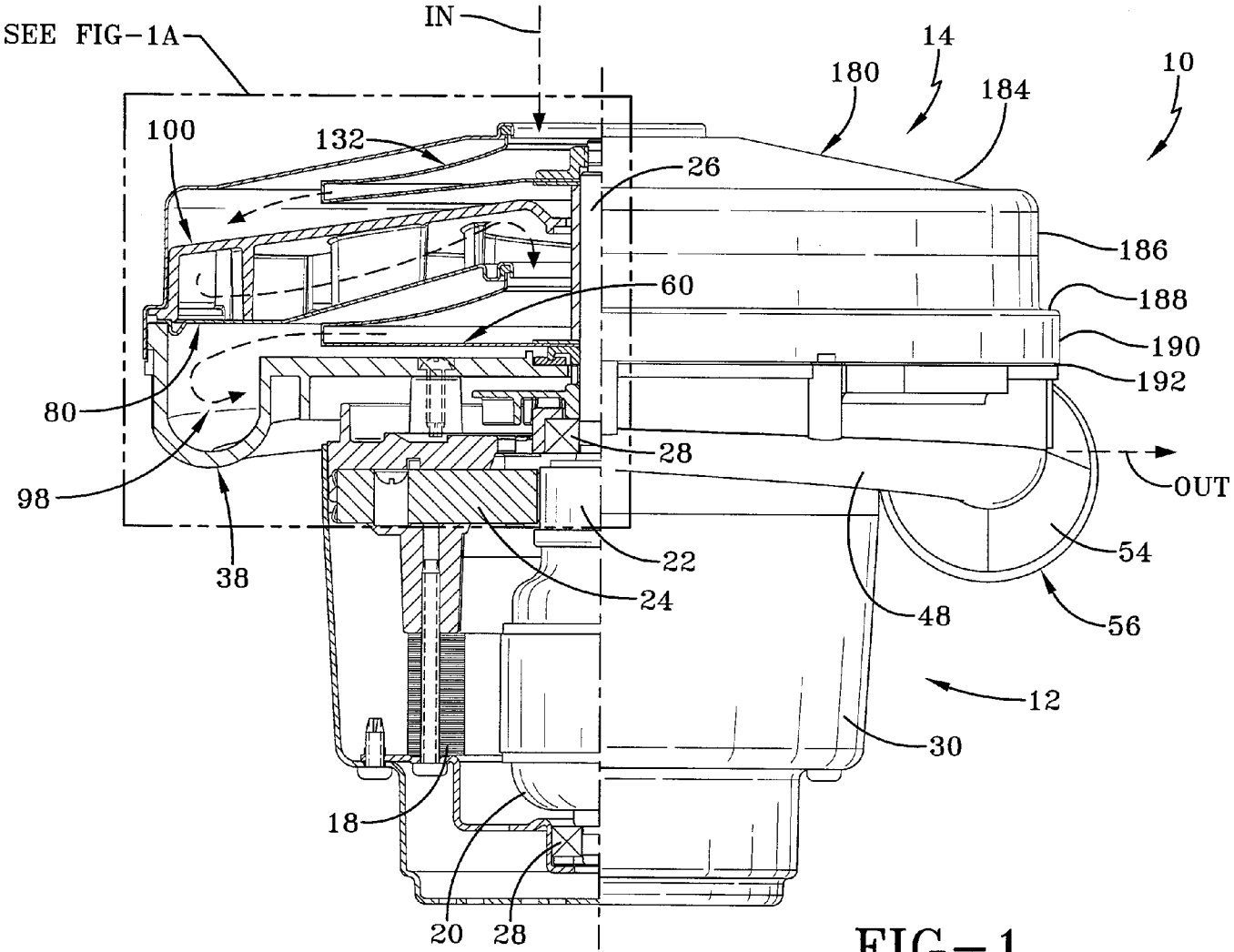
FIG. 1 is a partially sectioned front elevational view of a motor-fan unit according to the present invention showing the details of a motor assembly, an end plate assembly, a tapered fan, a tapered stationary fan with a concave underside, and a tapered fan with a concave underside.
Figure 1A:
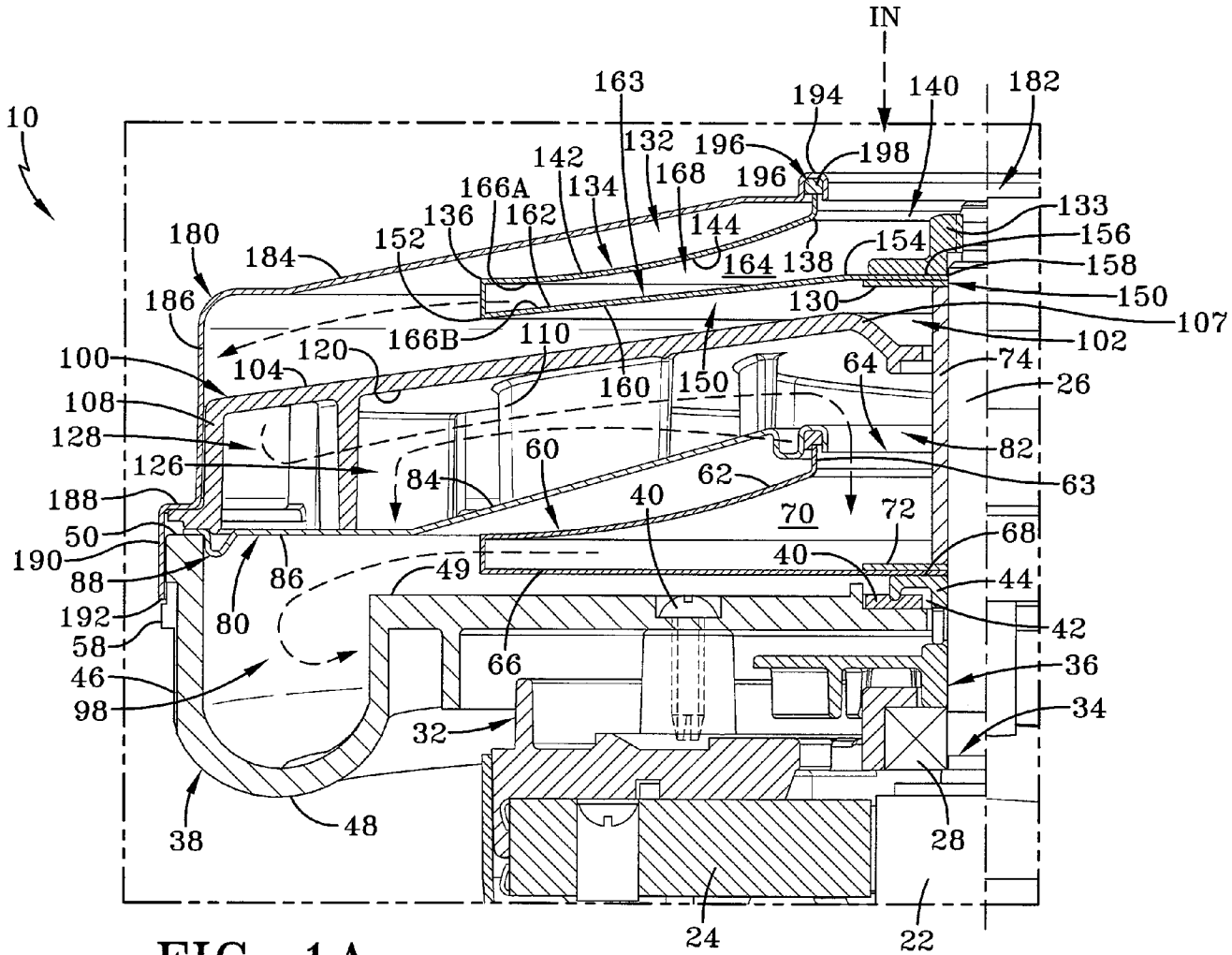
FIG. 1A is a detailed view of a portion of the cross-section of the motor-fan unit shown in FIG. 1.
Figure 2:
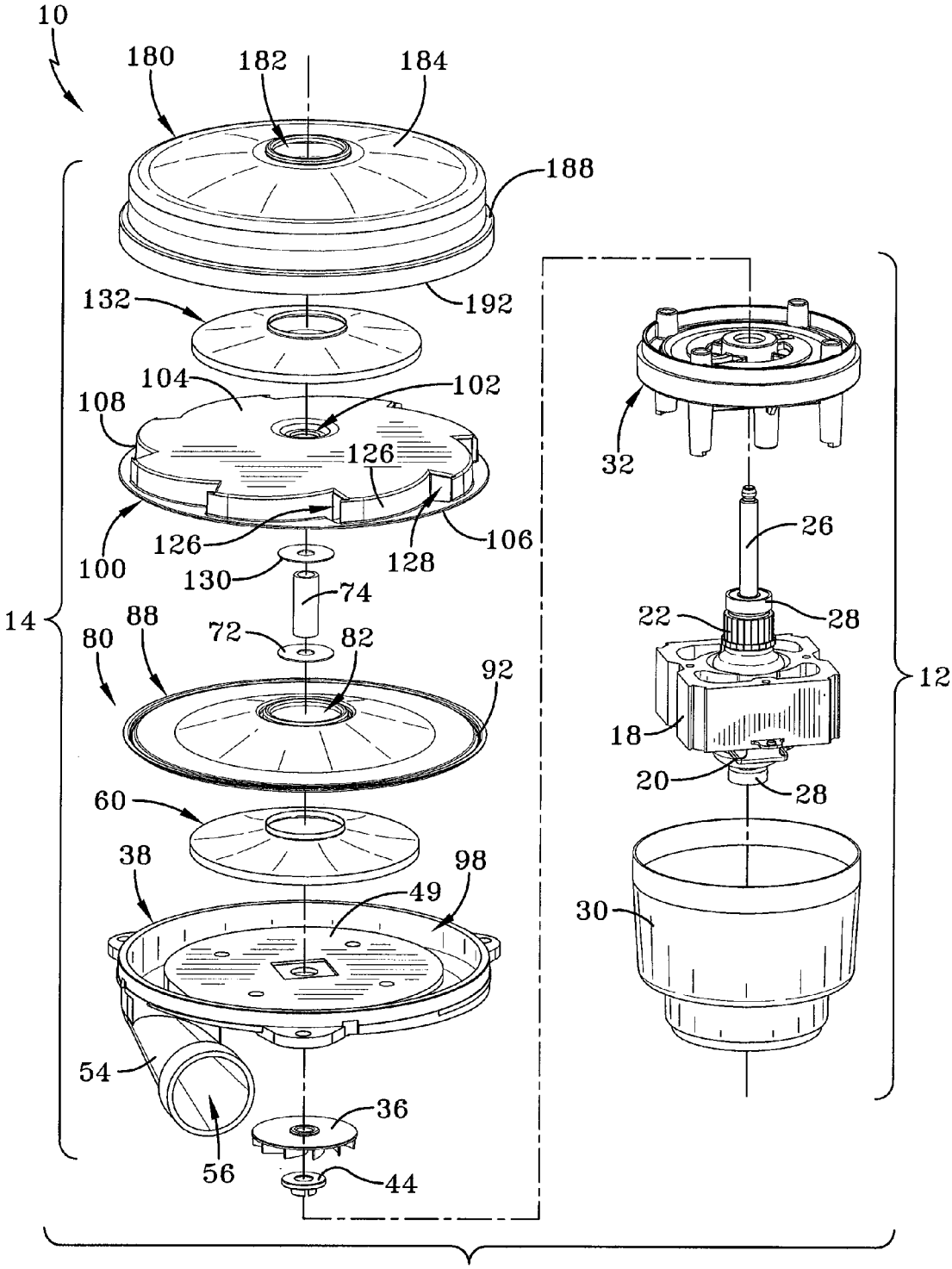
FIG. 2 is a top exploded perspective view of the motor-fan unit according to the present invention.

A motor-fan unit, indicated generally by the numeral 10 in the accompanying FIGS. 1, 1A, and 2, generally includes a motor assembly 12 and a fan assembly 14. The motor assembly 12 includes a lamination stack 18, which comprises a plurality of laminations, and which support field windings (not shown). An armature 20, which also includes a commutator 22 at one end thereof, is rotatably received within the lamination stack 18. A shaft 26 carries the armature 20 and commutator 22 and axially extends from both ends thereof. The shaft 26 is supported by a bearing 28 within a bracket assembly at one end and by another bearing 28 at about a mid-point of the shaft, wherein the remaining portion of the shaft extends into the fan assembly 14. The skilled artisan will appreciate that a pair of brushes 24 are carried by an end plate assembly, as will be described, and contact the commutator 22. Application of electrical current through the brushes and to the commutator 22 results in rotation of the shaft 26. A vented motor housing 30 surrounds the lamination stack 18, the armature 20, the commutator 22, the brushes 24, and any components related thereto.

An end plate assembly, designated generally by the numeral 32, is part of the motor assembly 12 and separates the brushes, commutator and other motor assembly related components from the fan assembly 14. It will be appreciated that one side of the end plate assembly 32 faces the components of the motor assembly and carries the brushes 24 in a positional relationship so as to allow them to contact the commutator 22. An opposite side of the end plate assembly 32 faces the fan assembly 14, carries the bearings 28, and provides for attachment connections to the components of the fan assembly. It will be appreciated that the end plate assembly 32 has an opening 34 extending therethrough which rotatably receives the motor shaft 26. An internal cooling fan 36 is disposed between the end plate assembly 32 and the motor fan unit 14 and is secured to the shaft 26. As such, when the motor shaft 26 is rotated by the motor assembly, the vanes of the internal cooling fan 36 generate a flow of air that is directed toward the motor windings maintained by the commutator and the armature, and the lamination stack so as to dissipate heat.

Figure 5:
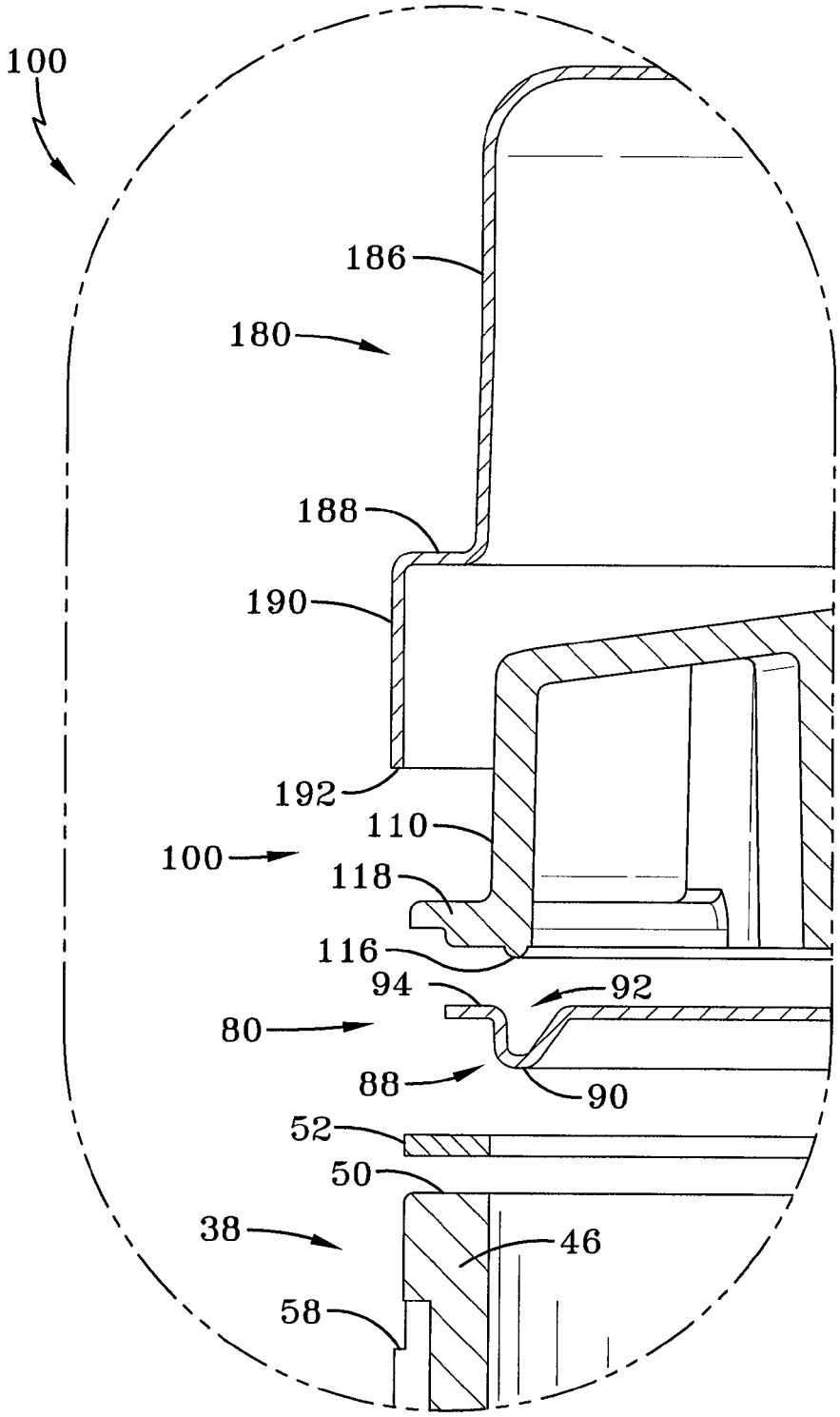
FIG. 5 is a detailed exploded view of the inter-relationship between the end plate assembly, a tapered fan shell, the tapered stationary fan, and a shroud.
Figure 6:
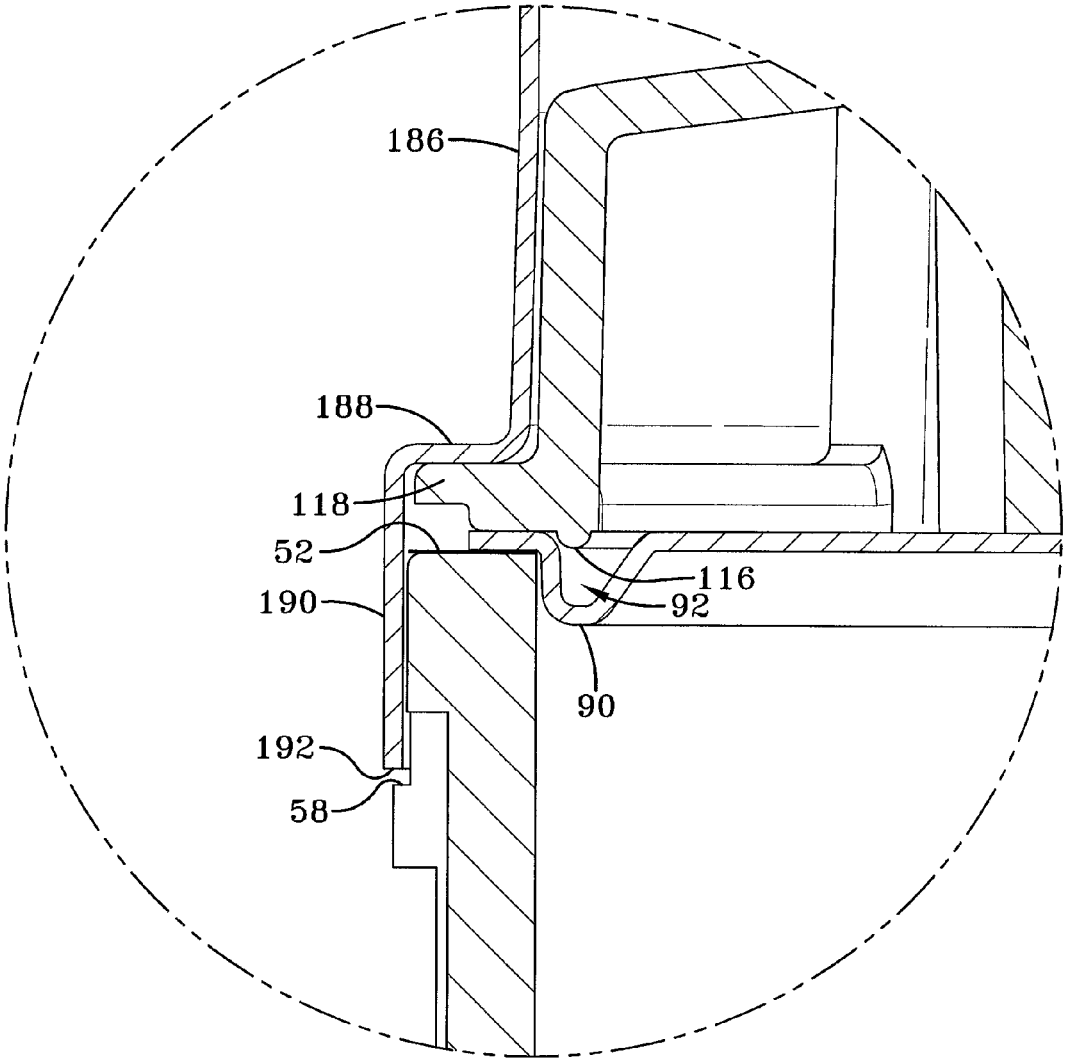
FIG. 6 is a detailed view of the inter-relationship shown in FIG. 5.

A discharge shell designated generally by the numeral 38 is secured to the end plate assembly 32 by fasteners 40. The discharge shell 38 has a shell opening 42 through which the motor shaft extends. A seal 43 is disposed about the opening 42 and a seal washer 44 is received over the shaft and rests upon the seal 43. The seal washer 44 may be constructed with lateral openings so as to allow for any moisture accumulated within the fan assembly to be drawn off by the internal cooling fan 36 and expelled radially away from the bearings 28. The discharge shell 38 provides an outer circular wall 46 that forms a gradually expanding radial tube 48 between the outer periphery formed by the wall 46 and a base 49. A top edge of the outer circular wall 46 forms a rim 50. A gasket 52, which may be made from a foamed polymeric material or equivalent and which is seen in FIGS. 5 and 6, is disposed over the rim 50. The tube 48 gradually expands so that air expelled by other components of the fan unit assembly 14 collects within the radial tube and is exhausted out the exhaust horn 54 which has an outlet 56. Further details of the airflow through the fan assembly will be discussed as the description proceeds. Extending radially outwardly from the circular wall is an outer ridge 58. The ridge 58 may be continuous or be provided in discontinuous portions. In other words, the ridge 58 may extend outwardly only from selected areas of the circular wall 46.

A rotating tapered fan 60 is positioned on the motor shaft and is supported by the seal washer 44. The fan 60 includes a fan ring 62 which is of a tapered frusto-conical construction. The fan ring includes a rim 63 that forms an inlet 64. Opposed to the fan ring 62 is a fan disc 66 which has an aperture 68 extending therethrough and which is positionally received adjacent the motor shaft. The fan disc 66 is substantially parallel to and positioned adjacent the base 49. A plurality of curvilinear and tapered fan blades 70 interconnect the fan disc 66 to the fan ring 62. A washer 72 is disposed over the shaft and rests upon the fan disc 66. An elongated bushing 74 is also disposed over the motor shaft 26 and one end rests upon the washer 72. The other end of the bushing 74 extends almost the entire length of the shaft 26 in a direction away from the motor assembly.

A tapered fan shell 80 is positioned over and on to the shaft and has an outer edge or periphery that rests upon the discharge shell 38. Specifically, the fan shell 80 has a central aperture 82 which is aligned with and fitted over the fan ring inlet 64. The fan shell 80 is tapered in an area such that the angular orientation of the fan shell is substantially parallel to and aligned with the fan ring 62 of the tapered fan 60. The fan shell 80 has a conical portion 84 extending from the aperture 82 and a flat portion 86 which extends from the conical portion 84. As best seen in FIG. 1A, the conical portion 84 is substantially parallel with the fan ring 62 and the flat portion 86 extends from the end of the conical portion to an outer edge 88 which fits on the periphery of the discharge shell 38. In other words, the angular taper of the conical portion 84 is similar to the overall angular slope or taper of the fan ring 62. The outer edge 88 is structured and sized to frictionally fit on the gasket 52 disposed on the rim 50 of the end plate assembly 32. The outer edge 88 includes a downwardly extending U-shaped ridge 90 that forms a groove 92. Extending from an end of the ridge 90 opposite the flat portion is a ledge 94. After the fan 60, the washer 72 and the bushing 74 are positioned on the shaft 26, the shell 80 is placed on to the end plate assembly 32. The U-shaped ridge 90 has a diameter sized to fit within the inner diameter of the circular wall 46. As a result, the shell 80 does not laterally move once installed on to the end plate assembly 32. Additionally, the ledge 94 sits or rests upon the gasket 52 and the rim 50. Together, when assembled, the discharge shell 38 and specifically the radial tube 48 form a chamber 98 which is of a substantially radial configuration.

Figure 3:
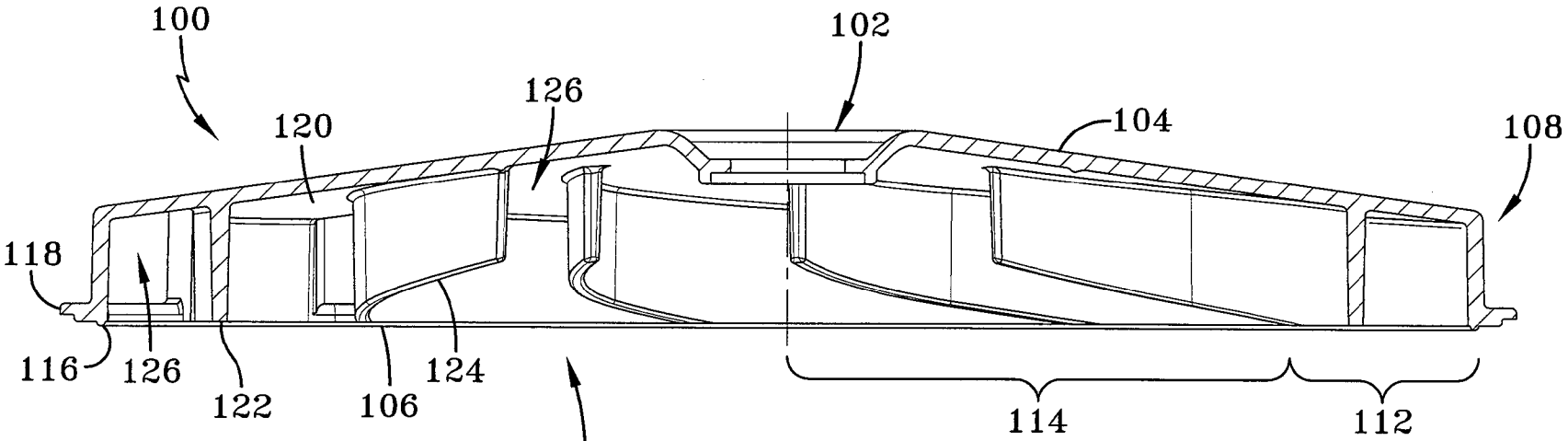
FIG. 3 is a cross-sectional view of the tapered stationary fan with a concave underside maintained by the motor-fan unit shown in FIGS. 1, 1A and 2.
Figure 4:
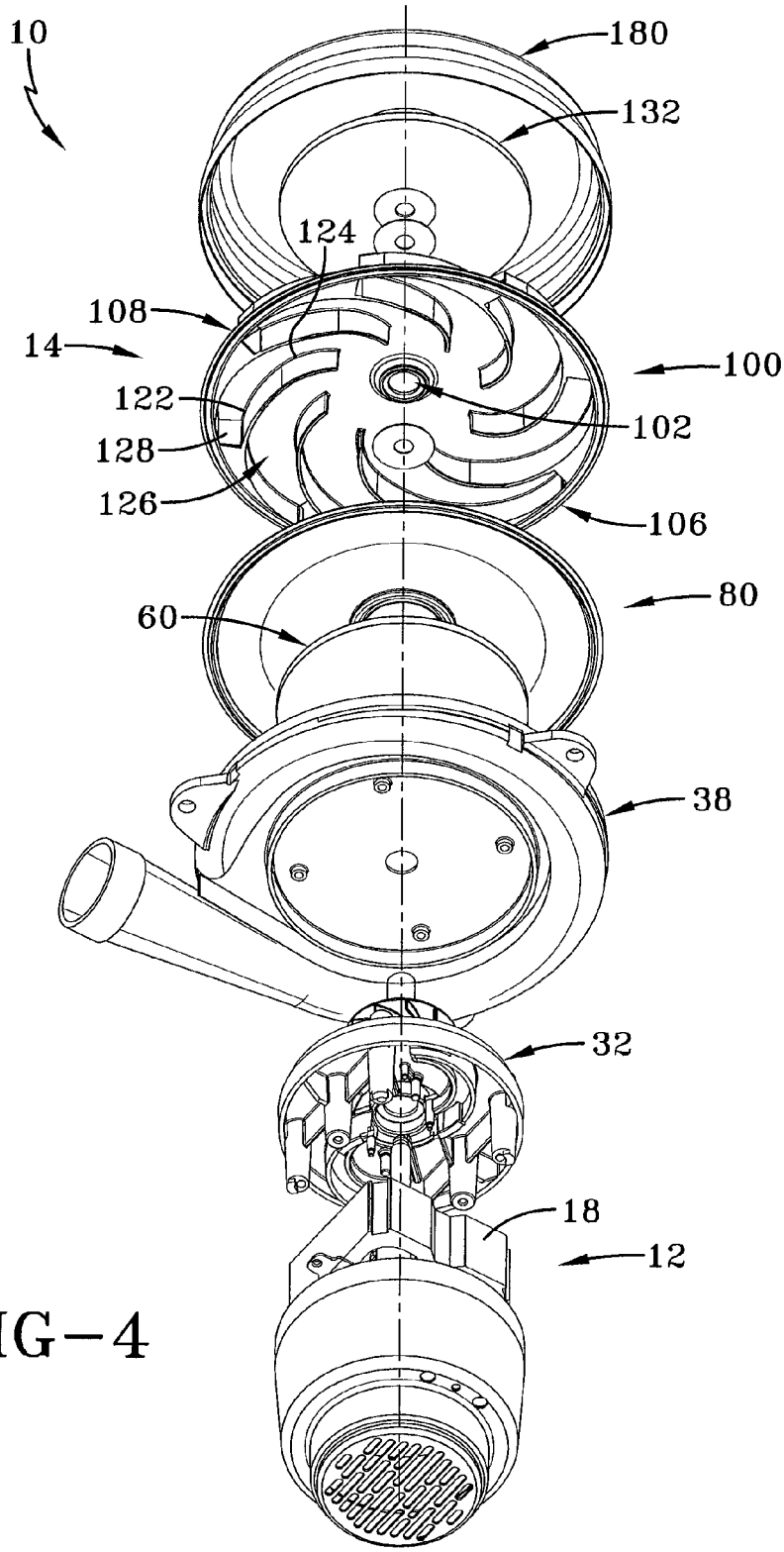
FIG. 4 is a bottom perspective view of the motor-fan unit according to the present invention.

A tapered stationary fan, which is best seen in FIG. 3, is designated generally by the numeral 100 and is positioned on and supported by the tapered fan shell 80. The stationary fan, which is sometimes referred to as a diffuser, has a shaft hole 102 extending therethrough which fits over the diameter of the bushing 74. The stationary fan 100 has a fan side 104 which is of a tapered configuration and a shell side 106 which is opposite the fan side. The fan side 104 has an apex 107 from which the fan side 104 extends angularly downward from. The shell side 106 is also tapered and as a result the stationary fan or diffuser has a concave underside. The shell side 106 is disposed adjacent and is in contact with the tapered fan shell 80. Indeed, as will become apparent, portions of the shell side 106 are in contact with both the conical portion 84 and flat portion 86 of the fan shell 80. Disposed between the sides of the stationary fan is a scalloped outer periphery 108 which provides an air flow transitional path from the fan side 104 to the shell side 106. The shell side 106 includes a fan side underside 120 from which extends the curvilinear walls 110. Specifically, a plurality of curvilinear walls 110, which are of substantially equal height, extend substantially downwardly and fit on the fan shell 80 to form a like number of channels 128. The curvilinear walls 110 are each configured so as to provide a flat/planar portion 112 about an outer radial portion of the shell side 106 and a tapered portion 114 which extends about the inner radial portion of the shell side 106. As best seen in FIG. 1A, the flat planar portion 112 rests or fits upon the flat portion 86 of the tapered fan shell and the tapered portion 114 rests or sits upon the conical portion 84. As such, the curvilinear walls 110 are fully supported by the top side of the tapered fan shell 80. The shell side 106 also includes a nub 116 which extends downwardly from the outer periphery 108. Indeed, the nub 116 extends downwardly from the entire outer periphery and is of such a diameter so as to fit in the groove 92 of the U-shaped ridge 90 of the fan shell 80. Extending radially outwardly from outer periphery 108 is a lip 118 that rests or sits upon the ledge 94 of the fan shell when the stationary fan is placed on top of the fan shell 80.

Closest to the outer periphery of the stationary fan 100, each curvilinear wall has a flat edge 122 which forms the planar portion 112. Extending radially inwardly from the planar portion 112 each curvilinear wall has a tapered edge 124. Collectively the tapered edges 124 form the tapered portion 114. Each curvilinear wall terminates or ends prior to reaching the shaft hole 102. As a result of providing curvilinear walls with a flat edge 122 and a tapered edge 124 and ensuring that those edges contact the tapered fan shell, distinct channels 126 are formed which feed into the central aperture region. These channels 126 have ports 128 about the outer periphery 108. This allows for air to move from the fan side 104 through the ports 128 and channels 126 formed by the curvilinear walls for transitioning into the inlet of the tapered fan 60. It will be appreciated that the shaft hole 102 is sized to frictionally fit over the outer diameter of the bushing 74 but is configured so as to not permit any significant air movement in between the shaft hole 102 and the outer diameter bushing.

As a result of the fan shell 80 and the shell side 106 extending angularly downward, the flat portion 86 and the lip 118 effectively overlap the rim 63 of the tapered fan 60. In other words, the relative position of the flat portion 86 and the lip 118 are lower in relation to the shaft 26 then the relative position of the rim 63. This overlap allows for the shaft length of the shaft 26 to be reduced and also allows for shortening of the fan assembly height.

A support washer 130 is disposed atop the bushing 74 and around the outer diameter of the shaft 26. As a result, the washer 130 sits above the center of the stationary fan 100. As seen in FIG. 1A, the washer 130 is positioned slightly above the apex 107 relative to the shaft 26.

A tapered fan 132, which has a concave underside, sits on the support washer 130 and is secured to the shaft with a threaded nut 133. It will be appreciated that the end of the shaft 26 has corresponding threads so as to allow for the nut 133 to secure the tapered fan 132 to the shaft. Securing the nut 133 to the shaft 26 secures both fans 60 and 134 to the shaft. Accordingly, rotation of the shaft by the motor assembly 12 causes rotation of the fans 134 and 60.

The tapered fan 132, which has a convex underside, includes a fan ring 134 which is provided in a substantially frusto-conical shape from its outer peripheral edge 136 to an inner edge 138. Extending through the ring 134 is an intake aperture 140, which is formed by the inner edge 138. The fan ring includes an external surface 142 which is positioned adjacent the underside of the shroud and an internal surface 144 that is opposite the external surface 142.

The fan 132 also includes a fan disc 150 which also provides a substantially frusto-conical configuration similar to but not exactly the same as the fan ring 134. The fan disc 150 includes an outer peripheral edge 152 which is substantially aligned with the fan ring peripheral edge 136. The fan disc 150 also includes a flat attachment ledge 154 which provides an inner edge 156 that forms an attachment aperture 158 that extends through the fan disc 150. The attachment aperture 158 receives the motor shaft 26 in such a manner that the fan disc 150 and, as such, the assembled fan 132 is secured to the motor shaft by the nut 170. The fan disc 150 includes an internal surface 162 that faces the fan ring's internal surface 144. Opposite the internal surface 162 is an external surface 160 which faces the tapered stationary fan 100. The flat attachment ledge 154 is sized so as to be slightly smaller in diameter than the intake aperture 140. The disc 150 includes a section 163 that is tapered from the outer periphery of the ledge 154 to the peripheral edge 152. In other words, the section 163 angularly extends from the ledge 154. As such, fan disc 150 forms an underside of the fan 132 which is concave. The fan disc 150 is substantially parallel with the fan side 104. In other words, the fan disc 150 is spaced apart from and in substantially the same angular orientation as the fan side 104 of the stationary tapered fan. As a result of the fan disc 150 extending angularly downward, the peripheral edge 152 effectively overlaps the apex 107 of the tapered diffuser 80. In other words, the relative position of the edge 152 is lower in relation to the shaft 26 then the relative position of the apex 107. This overlap allows for the shaft length of the shaft 26 to be reduced and allows for further shortening of the fan assembly height as compared to prior art fan assemblies.

A plurality of curvilinear vanes 164 are mounted and secured between the fan ring 134 and the fan disc 150. Each curvilinear vane has an upper vane edge 166A and a lower vane edge 166B wherein each of the edges matches the respective contour of the facing ring 134 and disc 144. In other words, in addition to the vanes 164 having a curvilinear shape, each of the vane edges is shaped so as to match the contour of the surface which it contacts. As such, an upper vane edge 166A is contoured to match the internal facing surface 144 of the fan ring 134. Likewise, the lower vane edge 166B is contoured to match the internal facing surface 162 of the fan disc 150. Each edge 166 is provided with a number of stakes which extend through corresponding openings provided in the fan ring 134 and fan disc 150. These stakes are then stamped in such a manner so as to secure the fan disc, fan ring and vanes 164 to one another. Skilled artisans will appreciate that the stakes extend only a minimal distance, if at all, from the surface of the fan ring and fan disc so as to preclude undesirable air currents from forming. Other structural or mechanical type fasteners could be used to secure the vanes 164 to the fan ring and the fan disc such as spot welding, frictional fit, fasteners, and the like.

A shroud 180 is disposed over and encloses the diffuser 100, the fan 60, the fan shell 80 and the tapered fan 132. The shroud 180 provides a central intake port 182 which is aligned with the motor shaft 26. The shroud 180 includes a cover portion 184 that has a frusto-conical shape. The frusto-conical shape of the cover portion 184 matches and is substantially parallel with the frusto-conical shaped fan ring 142. In other words, the cover portion 184 is spaced apart from and in substantially the same angular orientation as the fan ring 142. Extending from the cover portion 184 is a side wall 186 which terminates at a step 188 that fits on the stationary fan 100. The step 188 terminates at a rim edge 192 which fits upon the discharge shell 38. The intake port 182 is formed by a collar 194 which has an inlet channel 196 that is filled with friction material 198. This material engages a selected portion of the tapered fan 132 in a manner that will be discussed.

As best seen in FIGS. 5 and 6, the shroud 180 fits over the stationary fan 100, the fan 60, the fan shell 80 and the tapered fan 132. Specifically, the sidewall 186 is adjacent and bears against the selected portions of the scalloped outer periphery 108 of the stationary fan. The step 188 engages the top surface of the ledge 94 which causes the nub 116 to be received in the groove 92. This also forces the lip 118 to capture the ledge 94 against the gasket 52 and the rim 50. The step wall 190 frictionally engages the outer surface of the circular wall 46 such that the rim edge 192 may be supported by the outer ridge 58. As a result of this construction, any abnormal force that contacts the shroud 180 is transferred in such as manner as to be absorbed by the end plate assembly 32. Accordingly, the shroud is structurally supported and it does not deflect or collapse upon the tapered fan 132 during shipping, assembly, or otherwise.

As the motor assembly rotates the shaft 26, it rotates the tapered fan 136 which draws air in through the shroud intake port 182 and into the tapered fan 136. After the air is expelled out the peripheral edges of the fan blades, the air swirls around and is received within the ports 128 of the tapered stationary fan 100. These ports, which are on the outer periphery of the diffuser, receive the air which is then guided by the curvilinear vanes 120 to a central opening area and directed through the central aperture 82 of the tapered fan shell 80. This air flow is then directed into the tapered fan 60 and specifically the fan ring inlet 64. This air is then distributed through the channels formed by the adjacent fan blades 70 whereupon the air exits and enters the radial tube 48 and specifically the chamber 98 formed between the tapered fan shell 80 and the discharge shell 38. As the air gradually expands through this area, it exits the exhaust horn 54 at outlet 56.

The tapered fan 136 is provided with a relative top side that is convex and a relative underside which is concave. In other words, the side of the fan facing the shroud is convex and the side of the fan facing the tapered stationary fan and motor assembly is concave. As a result, the frusto-conical shapes of the fan disc and fan ring are aligned and substantially parallel to one another. Another feature of the vanes, the disc and the ring of the tapered fan is that each vane 140 is tapered and curved so that the exhaust apertures formed thereby have an inlet and an outlet, wherein the exhaust aperture decreases in height from the inlet to the outlet and increases in width from the inlet to the outlet.

By utilizing a tapered fan with a concave underside in conjunction with a tapered stationary fan, which also has a concave underside, the airflow through the motor-fan assembly is greatly improved. The tapered fan moves more of the weight of the fan toward the motor assembly such that the shaft is not required to provide additional rotational forces to overcome forces that would normally be further removed from the motor assembly. Utilization of tapered surfaces for the tapered fan 60, the stationary tapered fan 100, the fan plate 80, and the fan 132 moves the center of gravity of the fan assembly 14 as close as possible to the motor assembly so as to provide reduced stress on the motor shaft. This is advantageous in that less work is required by the motor to more efficiently move air through the assembly. Indeed, by providing a tapered rotating fan with a concave underside and tapered stationary fan with a concave underside significant overlapping of the fan assembly's component parts is obtained. This overlap allows for the shaft length to be reduced in comparison to prior art configurations which, in turn, reduces shaft flexing. This allows the shaft to rotate at higher speeds and improve operation of the motor-fan unit.

The present invention is also advantageous in that the stationary fan and fan end plate assembly are supported by the discharge assembly in such a manner that the fan shroud is further supported by just the discharge shell 38. In prior art embodiments, the stationary fan would have a separate shell that engaged the end plate assembly 32 with a separate shroud mounted on the intermediate shell. Shipment of these types of motors sometimes resulted in excessive force being applied to the shroud assembly which was only supported by the intermediate shell and as a result would deflect and crush the fan closely adjacent to the shell. As a result, the fan would be damaged and unable to rotate or operate efficiently resulting in return of the motor to the manufacturer. The present invention solves the aforementioned problem by providing a step in the shroud which is supported in two points, first by the stationary fan and secondly by the discharge shell 38.

Based upon the foregoing, the advantages of utilizing the fan 136 having a frusto-conical fan ring and fan disc allows for efficient and quiet air movement through the fan assembly. The airflow apertures 140 are configured so as to gradually increase pressurization of the air through the cross-sectional area from the inlet to the outlet so as to efficiently move the air without any air-flow anomalies that occur in prior art fan assemblies.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A motor-fan unit comprising:

an end plate assembly;

a motor assembly supported by said end plate assembly;

a shaft rotated by said motor assembly and extending through said end plate assembly; and a fan assembly supported by said end plate assembly, said fan assembly comprising:

a discharge shell attached to said end plate assembly;

a rotating fan secured to said rotatable shaft, said rotating fan having a fan disc with a substantially frusto-conical shape, a fan ring and a plurality of vanes connecting said fan disc to said fan ring;

a tapered stationary fan having a tapered fan side opposite a shell side and supported by said discharge shell, said tapered fan side positioned adjacent said fan disc, wherein said shell side has a concave shape with a plurality of curvilinear walls extending downwardly therefrom;

a fan shroud mounted on said discharge shell so as to substantially enclose said rotating fan and said tapered stationary fan, said fan shroud having an intake port; and a tapered fan shell interposed between said discharge shell and said shell side of said stationary fan, wherein said plurality of curvilinear walls have edges in contact with said tapered fan shell, and wherein said tapered fan shell has a conical portion and a flat portion, and wherein each said curvilinear wall has a flat edge that contacts said flat portion and a tapered edge that contacts said conical portion.

2. The motor-fan unit according to claim 1, wherein said fan ring has a substantially frusto-conical shape, and wherein said fan shroud has a frusto-conical cover portion substantially parallel with said fan ring.

3. The motor-fan unit according to claim 2, wherein said fan ring has an intake aperture extending therethrough which is aligned with said intake port.

4. The motor-fan unit according to claim 1, further comprising:

a second rotating fan secured to said rotatable shaft and interposed between said tapered fan shell and said discharge shell.

5. The motor-fan unit according to claim 4, wherein said fan shell has a central aperture extending therethrough and said second rotating fan has a second fan ring extending therethrough which is aligned with said central aperture.

6. The motor-fan unit according to claim 5, wherein said second fan ring has a substantially frusto-conical shape that is substantially parallel with said conical portion of said fan shell.

7. The motor-fan unit according to claim 1, wherein said tapered fan shell includes an outer edge extending from said flat portion, said outer edge having a U-shaped ridge that fits within said discharge shell and a ledge extending from said U-shaped ridge, said U-shaped ridge forming a groove.

8. The motor-fan unit according to claim 7, wherein said tapered stationary fan has an outer periphery with a downwardly extending nub and a radially extending lip.

9. The motor-fan unit according to claim 8, wherein said nub is received in said groove and said ledge rests upon said lip.

10. The motor-fan unit according to claim 9, wherein said fan shroud has a side wall with a step, wherein said lip and said ledge are captured between said step and said discharge shell.

11. The motor-fan unit according to claim 10, further comprising a gasket, said discharge shell having a circular wall with a rim, said gasket captured between said rim and said ledge.

12. A motor-fan unit comprising:

an end plate assembly;

a motor assembly supported by said end plate assembly;

a shaft rotated by said motor assembly and extending through said end plate assembly; and a fan assembly supported by said end plate assembly, said fan assembly comprising:

a discharge shell attached to said end plate assembly, said discharge shell having a circular wall with a rim;

a tapered fan secured to said rotatable shaft;

a tapered fan shell that includes an outer edge having a U-shaped ridge and a ledge extending from said U-shaped ridge, said U-shaped ridge forming a groove;

a stationary fan having a fan side and a shell side, said stationary fan having an outer periphery with a downwardly extending nub and a radially extending lip; and a rotating fan secured to said rotatable shaft;

wherein said tapered fan shell is interposed between said rim and stationary fan such that said U-shaped ridge is received within said circular wall and said nub fits in said groove.

13. The motor-fan unit according to claim 12, further comprising:

a fan shroud mounted on said discharge shell so as to substantially enclose said fan assembly, wherein said fan shroud has a side wall with a step, wherein said lip and said ledge are captured between said step and said discharge shell.

14. The motor-fan unit according to claim 13, further comprising:

a gasket captured between said rim and said ledge.

15. The motor-fan unit according to claim 14, wherein said stationary fan has an outer periphery with curvilinear walls that contact said fan shroud side wall.

16. The motor-fan unit according to claim 15, wherein said fan shroud has a step wall extending from said step, wherein said step wall terminates at a rim edge, and wherein said discharge shell has an outer ridge adjacent said rim edge when said fan shroud is assembled to said discharge shell.

* * * * *